US005417472A

United States Patent [19]

Elvinsson

[11] Patent Number: 5,417,472

[45] Date of Patent: May 23, 1995

[54] ARRANGEMENT IN A WHEELED APPLIANCE

[75] Inventor: Per Elvinsson, Gnosjo, Sweden

[73] Assignee: Etac AB, Anderstorp, Sweden

[21] Appl. No.: 50,011

[22] PCT Filed: Oct. 16, 1991

[86] PCT No.: PCT/SE91/00696

§ 371 Date: Apr. 29, 1993

§ 102(e) Date: Apr. 29, 1993

[87] PCT Pub. No.: WO92/06662

PCT Pub. Date: Apr. 30, 1992

[30] Foreign Application Priority Data

Oct. 23, 1990 [SE] Sweden ..... 90033762

[51] Int. Cl.[6] ..... A61H 3/00

[52] U.S. Cl. ..... 297/6; 297/331; 297/183.1

[58] Field of Search ..... 297/5, 6, 331, 335, 297/440.1, 183, 16.1; 135/67; 280/87.041

[56] References Cited

U.S. PATENT DOCUMENTS

| | | | |
|---|---|---|---|
| 897,737 | 9/1908 | Goodrich | 297/183 X |
| 2,798,533 | 7/1957 | Frank | 297/6 |
| 3,199,521 | 8/1965 | Ries | 135/67 |
| 3,537,748 | 11/1970 | Knapp | 297/16.1 X |
| 4,253,678 | 3/1981 | Leclerc | 280/42 |
| 4,449,732 | 5/1984 | Surot | 297/183 X |
| 4,643,211 | 2/1987 | Morris et al. | 135/67 |
| 5,020,560 | 6/1991 | Turbeville | 297/5 X |

FOREIGN PATENT DOCUMENTS

| | | |
|---|---|---|
| 410327 | 10/1966 | Switzerland . |
| 2154149 | 9/1985 | United Kingdom . |
| 2175948 | 12/1986 | United Kingdom . |

*Primary Examiner*—Kenneth J. Dorner
*Assistant Examiner*—Milton Nelson, Jr.
*Attorney, Agent, or Firm*—Beveridge, DeGrandi, Weilacher & Young

[57] ABSTRACT

A walker or rollator has a first frame section (1) fitted with handles (6) and pivotally connected to a second frame section (2) such that the rollator can be collapsed. Stays (9, 11) extend between the frame sections (1, 2) and are pivotally secured in each respective frame section and which, in a locking position, maintain the rollator in the position of use. A seat surface (15) is, with a first edge portion, pivotally connected to a joint (13) which connects the stays (9, 11) to one another, and with a second edge portion supportable on support member (16) on the one stay (11) adjacent the joint connection (12) thereof with the frame section (1). The load of the user on the seat surface (15) influences the stays (9, 11) towards the locking position.

20 Claims, 2 Drawing Sheets

FIG. 3
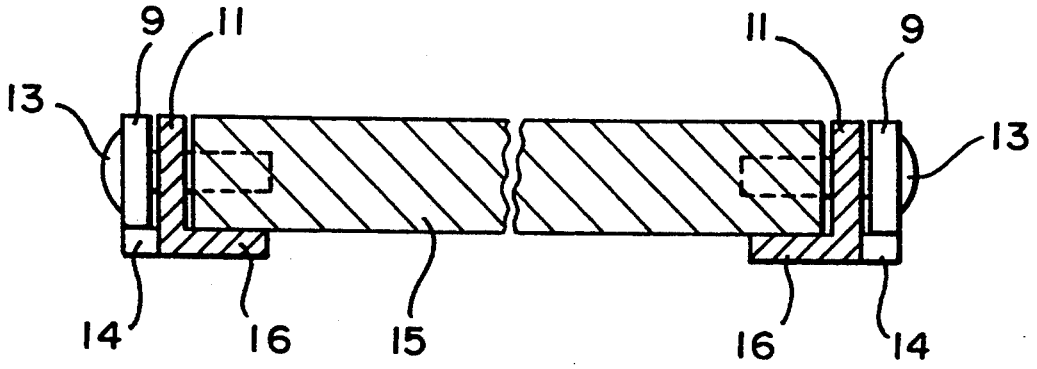
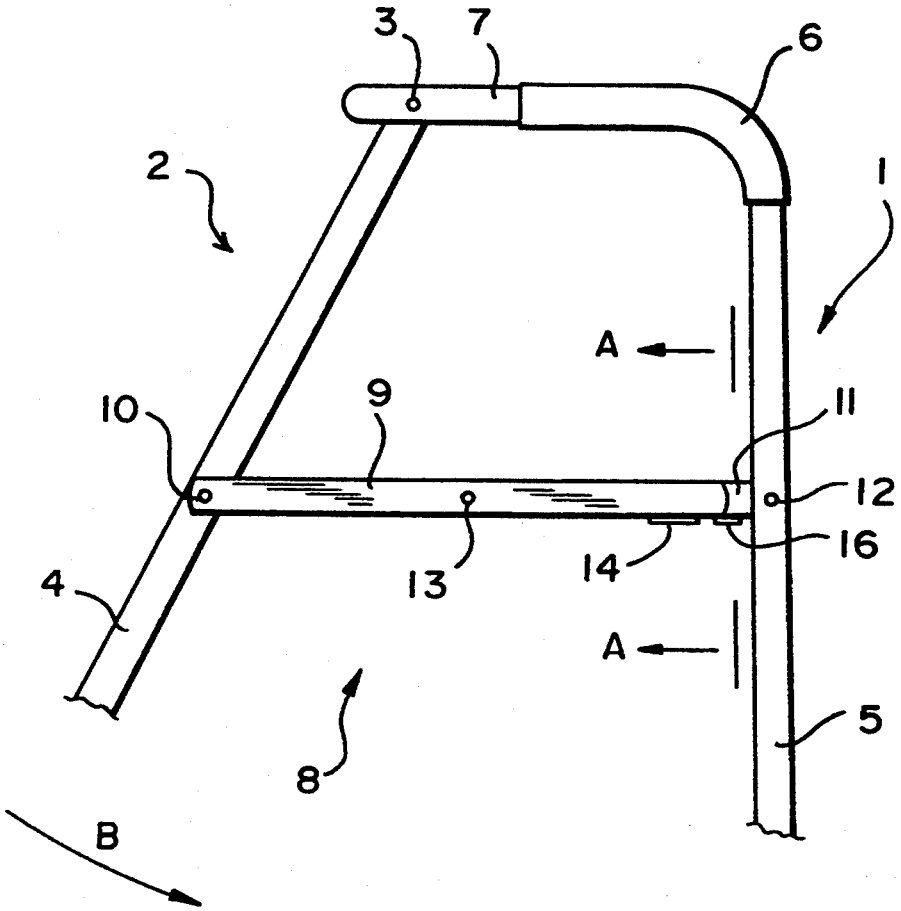
FIG. 1

ARRANGEMENT IN A WHEELED APPLIANCE

TECHNICAL FIELD

The present invention relates to such a wheeled implement or vehicle, preferably a so-called walker, wheeled walking frame or rollator , as has a first frame section fitted with handles for the user, and a second frame section which is pivotally connected with the first for switching of the implement between a collapsed position and an opened-out position of use, a stay arrangement extending between the frame sections and, in a locked position in relation to one another, positionally fixing the frame sections in the position of use.

BACKGROUND ART

An implement or a rollator of the type mentioned by way of introduction is previously known in the art and has, on the front frame section facing away from the user, a rigidly secured stay directed towards the rear frame section. The rear frame section has pivotal linkages which, in the longitudinal direction, are displaceable in relation to the rigidly disposed stay and which are fixedly lockable therein by means of a screw connection. The design and construction are such that there is a risk that the rollator may collapse under load if the locking screw has not been tightened.

The prior art rollator is further provided with a seat board which, with its front edge portion, rests on the rigidly secured stay. The seat board is so designed as to prevent inward collapse of the rollator, for which reason the seat board must first be raised before the rollator can be collapsed once the locking screws have been released. Hence, the procedure for collapsing or folding the rollator is unnecessarily circumstantial.

PROBLEM STRUCTURE

The present invention has for its object to realize an apparatus of the type disclosed by way of introduction, the apparatus being designed in such a manner that the risk of accidents by unintentional collapsing of the implement does not exist. The invention further has for its object to realize an apparatus which permits intentional collapsing in a very simple manner, in particular without the use of specific locking wheels, knobs or the like. Furthermore, the present invention has for its object to realize an apparatus in which its seat board may readily be switched between a lowered seating position and a raised position without the remainder of the apparatus being affected.

Finally, the present invention has for its object to realize an apparatus which is simple and economical in manufacture and which provides a high degree of stability.

SOLUTION

The objects forming the basis of the present invention are attained if the apparatus disclosed by way of introduction is characterized in that a seating surface in a first region is, via its side edges, moveably connected to or supportable on the stay arrangement between the connection region thereof with each respective frame section; that the seat surface is, in a second region, supportable on or connected with, respectively, support means either on the stay arrangement in the proximity of either of the frame sections, or directly thereon; and that the load of the user on the seat surface strives to move the stay arrangement towards the locking position.

In one preferred embodiment, the seat surface is pivotally connected to the stay arrangement in its first region.

In the preferred embodiment, it further applies according to the invention that the stay arrangement has, at each side of the implement, stays which are pivotally secured to one another and in each respective frame section; and that the stays on opposing sides of the implement are interconnected to one another by the intermediary of the seat surface.

These design and construction features afford the major advantage that the seat surface can be used as operating device or handle for maneuvering both of the stay arrangements simultaneously to a position for collapsing the implement.

In addition, the seat surface is pivotal, in relation to the stays, about a pivot shaft which pivotably interconnects the stays with one another. Further, the free edge portion of the seat surface is preferably provided with a handle or a grip. Each stay is disposed on the side of the walker. A first stay of each stay arrangement is disposed on the inside of a downwardly directed leg and a second stay, pivotably connected to the first stay, is disposed on the outside of a downwardly directed leg of the opposite frame section. Further, the second stay is preferably designed to extend past its pivotal connection with the first and is, with its free end portion, supported on a shoulder disposed on the underside of the first stay when the walker is in its position of use.

BRIEF DESCRIPTION OF THE ACCOMPANYING DRAWINGS

The present invention will now be described in greater detail hereinbelow with particular reference to the accompanying Drawings, in which:

FIG. 1 shows, straight from the side, the upper portion of an implement designed according to the present invention and opened out to the position of use;

FIG. 3 is a section taken along the line A—A in FIG. 1.

DESCRIPTION OF PREFERRED EMBODIMENT

Figure 2:
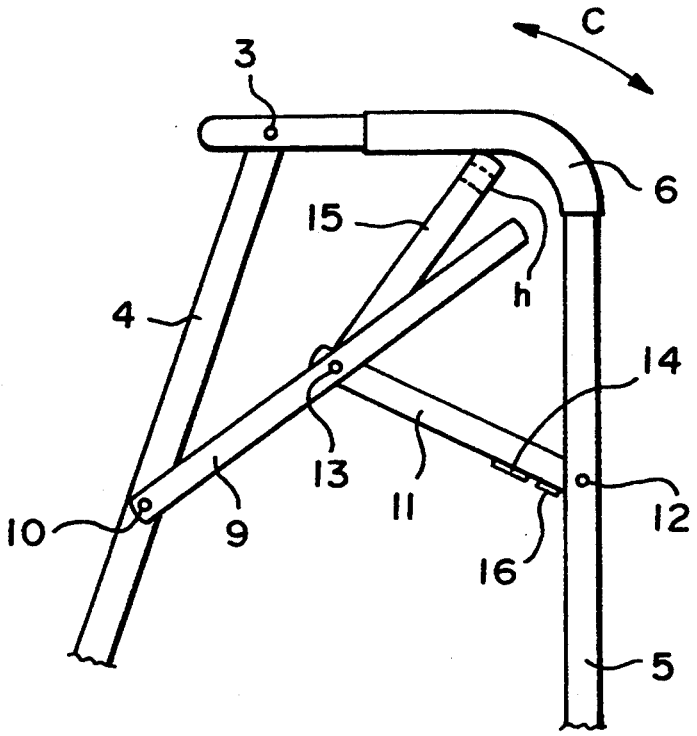
FIG. 2 shows the implement in a view corresponding to that of FIG. 1, but in a partially collapsed position.
Figure 4:
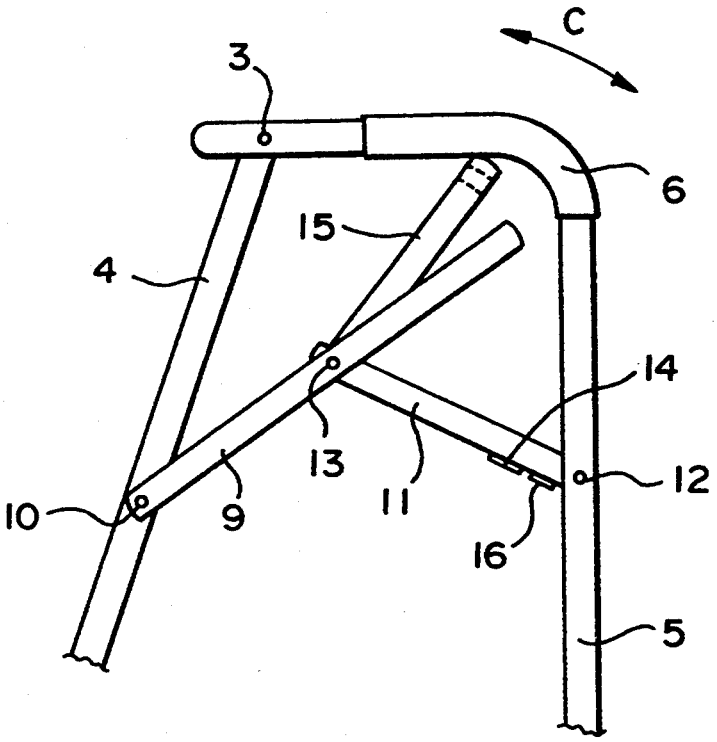
FIG. 4 shows an opposite side of the implement shown in FIG. 2.

It will be apparent from FIG. 1 that the implement or rollator has a first or front frame section 2 and a second, rear frame section 1, these two frame sections being pivotally interconnected by the intermediary of joints 3 so that the frame sections will be pivotal in relation to one another in accordance with the arrow B from the opened out position of use illustrated in FIG. 1 to a collapsed position in which the front frame section 2 is located parallel with or adjacent the rear frame section 1.

The front frame section 2 has legs 4 which, running approximately in the vertical plane, are downwardly directed and substantially parallel with one another and which, at their lower ends, are provided with wheels (not shown on the Drawings). Correspondingly, the rear frame section 1 has downwardly directed legs 5 which also run approximately in the vertical plane and are approximately parallel with one another. The upper ends of the legs 5 of the rear frame section 1 merge, via bent regions which also constitute handles 6 for maneuvering the rollator, into approximately horizontal forwardly-directed portions 7 which, at their front ends, are united to one another such that they, together with this uniting portion, assume the configuration of a U from above. The legs 5 in the rear frame section 1 are also provided with wheels in their lower ends (not shown).

In order to keep the rollator in the outwardly opened position of use, the two frame sections 1 and 2 are, beneath the forwardly directed portions 7, interconnected to one another by the intermediary of a stay arrangement 8 at each side of the rollator. Each such stay arrangement includes one longer forward stay 9 which, by means of a joint 10, is secured in the downwardly directed legs 4 on the front frame section 2. Furthermore, the stay arrangement is provided with a rear stay 11 which, by the intermediary of a joint 12, is secured in the downwardly directed legs 5 of the rear frame section. The forward and rear stays are united to one another by the intermediary of a joint 13, and the forward stay 9 is of such a length that it considerably extends beyond the joint 13 in order to be able to come into abutment against a shoulder 14 laterally projecting on the under side of the rear stay. In this opened out position of use, the pivot shafts for the joints 10, 13 and 12 suitably lie along a straight line, or the central joint 13 lies somewhat beneath this line so that a self-locking effect is achieved.

According to the invention, it is also possible to place the stays 9 and 11 the other way about so that the longer stays 9 are secured in the rear frame section 1 while the shorter stays 11 are secured in the front frame section 2.

It will be apparent from the above description of the stay arrangement 8 and from FIG. 2 that a lifting of the central portion of the stay arrangement somewhere in the region of the joint 13 will realise a pivoting together of both of the frame sections 1 and 2 towards one another. On the other hand, a depression of the central portion of the stay arrangement is prevented in that the end of the longer stay will come into abutment against the shoulder 14. Since collapsing is effected in an upward direction, it will also be perceived that vibrations in combination with the forces of gravity cannot unintentionally cause the rollator to collapse.

According to the invention, the rollator is provided with a seat board 15 which, with a forward or first region, is moveably interconnected, by the intermediary of opposing edge portions, to the stay arrangements 8 such that it unites both of the stay arrangements 8 on each side of the rollator. Hereby, the stay arrangements can be operated jointly and simultaneously by a corresponding actuation of the seat board.

In the embodiment according to FIG. 2, the forward or first edge portion of the seat board 15 is pivotally secured in the joints 13 such that the seat board is pivotal as shown by the arrow C irrespective of the adjustment position of the stay arrangement 8. The rear or second end of the seat board 15 is, after pivoting in a clockwise direction, supportable on support means 16 on the rear stays 11. Hereby, the seat board 15 can, with the rollator opened out to the position of use, assume two different positions independently of the stay arrangements 8, namely a lowered seating position and a raised position in which it is out of the way and in which it may facilitate in collapsing the rollator.

For easy collapsing of the rollator, the seat board 15 is provided, in the central region at its rear edge, with a handle or grip h, possibly an aperture, which facilitates pivoting of the seat board with the rear edge upwardly in a counterclockwise direction. By such a combined pivoting and raising of the seat board, the stay arrangements 8 will be collapsed together and, thereby, also the rollator proper. As a result, an extremely simple and uncomplicated collapsing of the entire rollator is possible.

As will be apparent from the above description, a load on the seat board when this is in use, will be directed downwardly, for which reason this load acts on the stay arrangements in that direction in which they are moved to the locking position on use. Load on the seat board will thus entail an extra safety measure against unintentional collapsing of the rollator.

It will be apparent from the Drawings that the forward stays 9 are placed on the outside of both of the downwardly directed legs 4 of the front frame section 2, while the rear stays 11 are placed interiorly on the inside of the downwardly directed legs 5 of the rear frame section. Since the seat board is, in the lowered position, located between the rear stays 11, this placing of the stays will automatically entail that the seat board is not prevented from being pivoted or lifted by cooperation with the legs 5.

The opposite placing of the stays 9 and 11 is, of course, also possible.

FIG. 3 shows a vertical partial section according to the section line A—A in FIG. 1. It is apparent from this Figure that the seat board 15 may be secured in the stay arrangements 8 by means of the shafts or pins which form the joints 13. It is also apparent that the support means 16 extend inwardly beneath the edge region of the seat board, while, on the other hand, the shoulders 14 are located on the outside of the rear stays 11 in order thereby to support the front ends of the forward stays 9.

DESCRIPTION OF ALTERNATIVE EMBODIMENTS

In the foregoing, the seat board 15 has been described as movable, preferably pivotally secured in the stay arrangements by the intermediary of the joints 13. However, this is not necessary, but a forward edge portion of the seat board may of course instead be secured in a separate anchorage device or joint in the forward stays 9 ahead of the joints 13 or possibly in the rear stays 11 behind the joints 13. In order to retain the easy collapsibility via the seat board, it is sufficient that the forward edge of the seat board be pivotally connected to the stay arrangements somewhere between their anchorage joints 10 and 12 in each respective frame section.

As yet a further alternative in respect of the moveably mounted seat board 15, mention might be made that the seat board can, via opposing edge portions preferably in its forward region, be shiftable along the longitudinal direction of the outwardly opened stay arrangements 8.

According to the invention, the support means 16 for the rear edge of the seat board 15 may be placed directly on the rear frame section 1.

While the easy collapsing of the rollator is lost, it is, naturally, also possible to pivotally connect the rear edge of the seat board to the rear stays 11 or possibly the legs 5 and to allow the forward edge of the seat board to rest on suitable support members somewhere along the stay arrangements 8, preferably in the central region thereof. Hereby, the extra safety measure against unintentional collapsing of the rollator will also be retained.

The present invention may be modified further without departing from the spirit and scope of the appended claims.

I claim:

1. A walker, comprising:

a front frame member and a rear frame member, said rear frame member having handles for grasping of the walker by an operator, said front and rear frame members being, at upper portions thereof, pivotably connected to one another such that the walker is transferable between a collapsed position for non-use and an erected position for use, first and second stay arrangements extending, at opposite sides of the walker and below said handles, between the frame members, said stay arrangements being lockable so as to lock the frame members in the position for use;

pivot connections connecting opposite end portions of the stay arrangements to said front and rear frame members;

a seat member having, at a front end edge portion thereof, pivot means, said pivot means connecting the seat member to each of the stay arrangements at a position between the pivotal connections of the stay arrangements to the frame members so that the seat member is pivotable between an essentially horizontal position for use and a pivotably spaced position for non-use, and said seat member including a handle or gripping portion provided at the rear end thereof.

2. A walker as claimed in claim 1, wherein said stay arrangements, on mutually facing interior sides, are each provided with a support for supporting a rear end portion of the seat member.

3. A walker as claimed in claim 1, wherein said seat member has an aperture formed at a rear end thereof for providing a handle gripping location, and said pivot connection between said stays in each stay arrangement extends into said seat member such that said seat member shares a common pivot axis with said stays in each stay arrangement.

4. A walker as claimed in claim 1, wherein each stay arrangement comprises two stays pivotably connected to one another at a position between the pivotal connections of the stay arrangements to the frame members, and each stay arrangement being dimensioned and arranged so as to be transferable from a locking position to a collapsed position by relative pivoting of the two stays in each stay arrangement.

5. A walker as claimed in claim 4, wherein the pivot means of said seat member has a common pivot axis with the pivots provided between the stays in each stay arrangement whereby the seat member with handle and the stay arrangements are dimensioned and arranged such that the stay arrangements are transferable from a locked position to a collapsed position by an operator grasping the handle of the seat member and pulling the seat member upwardly toward the operator.

6. A walker, comprising:

a front frame member and a rear frame member, said rear frame member having, at an upper end thereof, handles for grasping of the walker by an operator, said front and rear frame members being, at an upper portion thereof, pivotably connected to one another such that the walker is transferable between a collapsed position for non-use and an erected position for use;

a first and a second stay arrangement extending between the frame members at opposite sides of the walker and spaced below said handles;

a seat member having at a front end portion thereof, pivot means connecting the seat member to said stay arrangements at a position between opposite ends of said stay arrangements, the seat member having a substantially horizontal position for use in which a rear portion of the seat member is supported on supports arranged on a rear end portion of each of the stay arrangements, the seat member being pivotal to a position for non-use thereby providing a free space between rear portions of the stay arrangements and between downwardly extending legs of the rear frame member.

7. A walker as claimed in claim 6, wherein each stay arrangement comprises two stays pivotably connected to one another about a pivot location, said stay arrangements being transferable from a locked position to a collapsed position by relative pivoting of the stays in each stay arrangement.

8. A walker as claimed in claim 7, wherein the seat member has, at a rear portion thereof, a handle or a gripping member, and said pivot means connecting the seat member to the stay arrangements has a common pivot axis with the pivot location of the stays in each of said stay arrangements, whereby the walker is collapsible upon the seat handle or gripping portion being drawn upwardly and toward the operator.

9. A walker as claimed in claim 7, wherein said pivot means includes a pivot pin which extends from said seat member so as to provide the pivotable connection between the stays in each stay arrangement.

10. A walker, comprising:

a front frame member and a rear frame member, said front and rear frame members being, at an upper portion thereof, pivotably connected to one another such that the walker is transferable between a collapsed position for non-use and an erected position for use, and said rear frame member comprising spaced apart downwardly extending legs, and said front frame member comprising spaced apart downwardly extending legs; and a first and a second stay arrangement extending longitudinally between the frame members on opposite sides of the walker, each stay arrangement being, at opposite ends thereof, pivotably connected to the front and rear frame members, and each stay arrangement comprising one front and one rear stay pivotably connected to one another at a mid region of the respective stay arrangement, said rear stays being provided on inner sides of the downwardly extending legs of the rear frame member, said front stays being provided on outer sides of the downwardly extending legs of the front frame member, and each of said front stays further extending, when the walker is in the erected position, rearwardly of the pivotal connection to the rear stay so as to have a free end portion supported on an abutment on a respective one of the rear stays, whereby, when loaded in a downward direction, the stays are placed in a locking position so as to lock the walker in the erected position, and said walker further comprising a seat member supported by said stay arrangements and a pair of laterally spaced support members which abut said seat member so as to retain it in a seating position.

11. A walker as recited in claim 10 wherein said seat member is pivotably connected to said stay arrangements by pivot means including a pin which extends through said stays in each stay arrangement to provide the pivot connection between said stays in each stay arrangement.

12. A walker as claimed in claim 10, wherein said seat member is pivotably supported on the stay arrangements whereby, when the seat member is loaded, the stays are downwardly loaded so as to facilitate maintaining the walker in the locked, erected position.

13. A walker as claimed in claim 12, wherein the seat member is, at a front end portion thereof, pivotably connected to the stays, and a rear end of said seat member is supported on said pair of support members which extend off of said rear frame member.

14. A walker as claimed in claim 12, wherein the seat member is provided with a handle or a gripping portion at a rear portion thereof.

15. A walker as claimed in claim 12, wherein the seat member is, at a front end portion thereof, pivotably connected to the front stays, and a rear end of said seat member is supported by said pair of support members which extend off of said rear stays.

16. A walker as claimed in claim 15, wherein the pivotal connection between the seat member and the stays forms a pivot axis that is in common with the pivot axis defined by the pivotal connection between the stays in each stay arrangement.

17. A walker, comprising:

a front frame member and a rear frame member, said rear frame member having, at an upper end thereof, handles for grasping of the walker by an operator, said front and rear frame members being, at an upper portion thereof, pivotably connected to one another such that the walker is transferable between a collapsed position for non-use and an erected position for use;

a first and a second stay arrangement extending between the frame members at opposite sides of the walker and spaced below said handles;

a seat member having, at a front end portion thereof, pivot means connecting the seat member to said stay arrangements at a position between opposite ends of said stay arrangements, the seat member having a substantially horizontal position for use in which a rear portion of the seat member is supported on supports arranged on the rear frame member, the seat member being pivotal to a position for non-use thereby providing a free space between rear portions of the stay arrangements and between downwardly extending legs of the rear frame member.

18. A walker as claimed in claim 17, wherein each stay arrangement comprises two stays pivotably connected to one another about a pivot location, said stay arrangements being transferable from a locked position to a collapsed position by relative pivoting of the stays in each stay arrangement.

19. A walker as claimed in claim 18, wherein the seat member has, at a rear portion thereof, a handle or a gripping member, and said pivot means connecting the seat member to the stay arrangements has a common pivot axis with the pivot location of the stays in each of said stay arrangements, whereby the walker is collapsible upon the handle or gripping portion being drawn upwardly and toward the operator.

20. A walker as recited in claim 21 wherein said seat member and stays in each stay arrangement share a common pivot.

* * * * *